US006854877B2

(12) United States Patent
Hoobyar et al.

(10) Patent No.: US 6,854,877 B2
(45) Date of Patent: Feb. 15, 2005

(54) MIXER FOR ASEPTIC LIQUIDS

(75) Inventors: Luther Thomas Hoobyar, Palo Alto, CA (US); Donald W. Greear, Vancouver, WA (US); Mark R. Embury, Fremont, CA (US)

(73) Assignee: Aseptic Controls Investment Co., San Francisco, CA (US)

( * ) Notice: Subject to any disclaimer, the term of this patent is extended or adjusted under 35 U.S.C. 154(b) by 0 days.

(21) Appl. No.: 10/272,847

(22) Filed: Oct. 16, 2002

(65) Prior Publication Data

US 2004/0076076 A1 Apr. 22, 2004

(51) Int. Cl.[7] ..... B01F 13/08
(52) U.S. Cl. ..... 366/274; 366/314
(58) Field of Search ..... 366/274, 273, 366/314

(56) References Cited

U.S. PATENT DOCUMENTS 3,279,765 A * 10/1966 Sato et al. ..... 366/273
4,993,841 A * 2/1991 Lofgren et al. ..... 366/274
5,393,142 A * 2/1995 Meier ..... 366/274
5,407,272 A * 4/1995 Meier ..... 366/274
5,470,152 A * 11/1995 Rains ..... 366/273
5,478,149 A * 12/1995 Quigg ..... 366/273
5,758,965 A * 6/1998 Gambrill et al. ..... 366/273
5,779,359 A * 7/1998 Gambrill et al. ..... 366/273
5,906,105 A * 5/1999 Ugolini ..... 366/274
6,065,865 A * 5/2000 Eyraud et al. ..... 366/273
6,206,562 B1 * 3/2001 Eyraud et al. ..... 366/273
6,467,944 B2 * 10/2002 Ugolini ..... 366/273

* cited by examiner

*Primary Examiner*—Tony G. Soohoo

(57) ABSTRACT

A mixer for an aseptic liquid in a vessel having a wall comprising a weldment post having a distal extremity inside the wall and having a proximal extremity outside the wall. The weldment post has a bore therein extending out through the proximal extremity of the weldment post. A motor driven magnet drive assembly is disposed in the bore in the weldment post. A hub carrying impellers is rotatably mounted on the weldment post. A magnet driven assembly is mounted in the hub and is disposed in close proximity to the magnet drive assembly but is separated therefrom by a liquid-tight seal. The magnet drive assembly includes a plurality of circumferentially spaced apart driven permanent magnets which are caged by bars to prevent movement of the driven permanent magnets with respect to the hub.

30 Claims, 4 Drawing Sheets

MIXER FOR ASEPTIC LIQUIDS

This invention relates to a mixer for aseptic liquids.

Magnetically driven mixers have heretofore been provided. They have been commercially available from Vestec-Moritz Ltd., Lightning and Apco Technologies as well as others. These commercially available magnetic mixers share a number of shortcomings. Typically such mixers have relatively large diameter weldments which require a large hole in the bottom wall of the tank. This large hole increases the lack of clearance in a typically already crowded region of the tank. In addition this large diameter opening increases the tendency of warpage in the tank bottom wall during contraction which occurs during welding of the weldment. This tendency for increased warpage causes variations in the assembly of the mixer and often causes weakening of the magnetic coupling in the mixer, resulting in inconsistent mixing. Also commercially available mixers are often difficult to clean in place. There is therefore a need for a new and improved mixer for aseptic liquids which overcomes these difficulties.

In general, it is an object of the present invention to provide a mixer for aseptic liquids in which closer and more reliable tolerances are achieved to provide improved magnetic coupling, making it possible to deliver higher torque.

Another object of the invention is to provide a mixer of the above character in which a weldment is provided for the tank in which the mixer is located that can accommodate a thick rigid weld to inhibit or prevent warpage of the tank bottom wall.

Another object of the invention is to provide a mixer of the above character having driven magnets which are caged to provide a rigid and permanent mounting for the magnets.

Another object of the invention is to provide a mixer of the above character which is designed to facilitate cleaning.

Another object of the invention is to provide a mixer of the above character which has capabilities for retaining the liquid within the tank in motion during draining of the tank.

Another object of the invention is to provide a mixer of the above character in which capability is provided for measuring the rotation of the hub from outside of the tank.

Additional objects and features of the invention will appear from the following description in which the preferred embodiments are set forth in detail in conjunction with the accompanying drawings.

Figure 1:
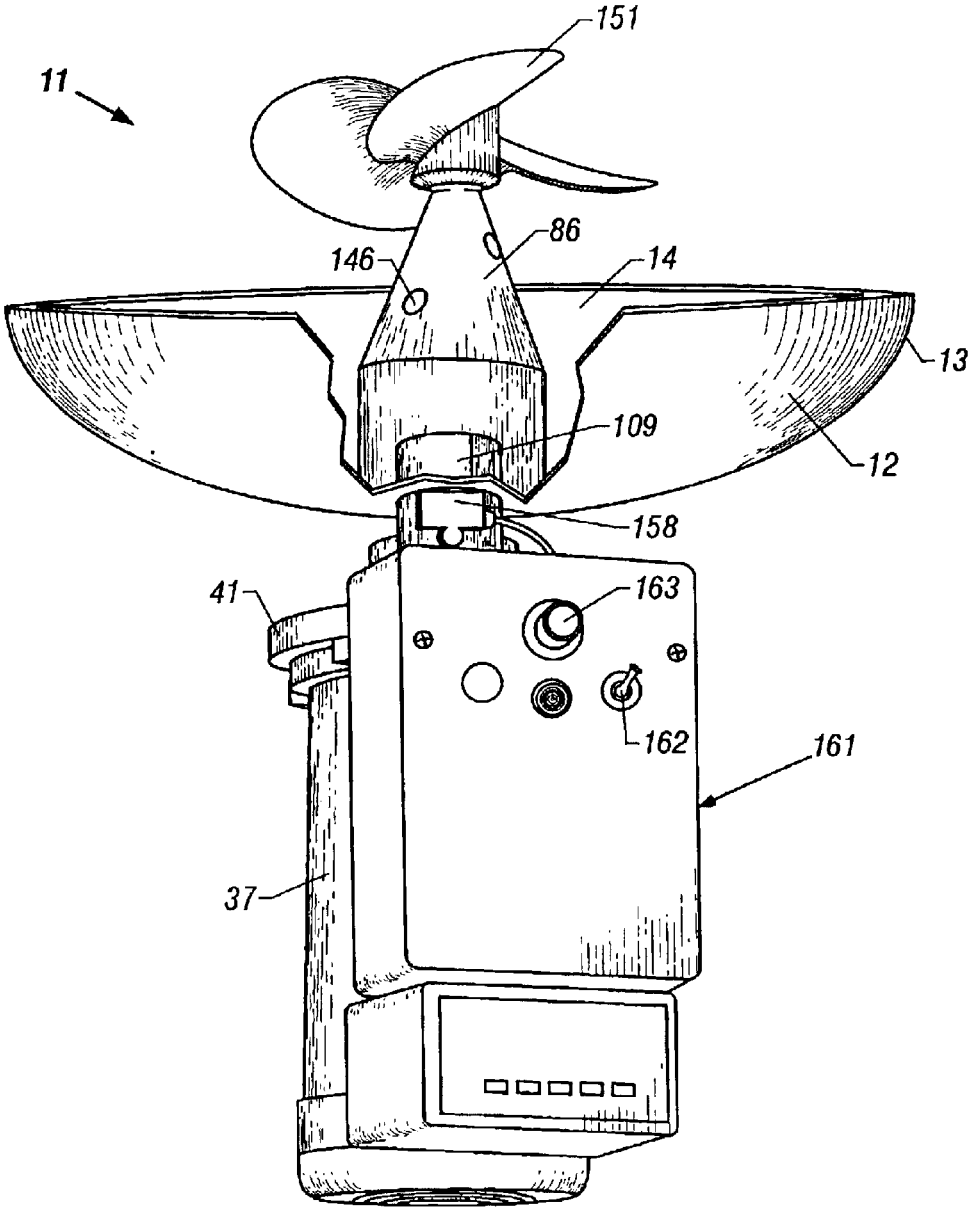
FIG. 1 is a perspective view of a mixer for an aseptic liquid incorporating the present invention shown mounted in the bottom wall of a tank.

A mixer for an aseptic liquid in a vessel having a wall and having an opening therein and containing the aseptic liquid to be mixed comprises a weldment post extending through the opening in the wall and being adapted to be welded into the wall to form a liquid tight seal with the wall of the vessel. The weldment post has a distal extremity inside the wall and has a proximal extremity outside the wall. The weldment post has a bore therein extending out through the proximal extremity of the weldment post. A magnet drive assembly is disposed in the bore in the weldment post. A drive motor is carried by the weldment post for driving the magnet drive assembly. A hub is rotatably mounted on the weldment post. Impellers are mounted on the hub. A magnet driven assembly is mounted in the hub and is disposed in close proximity to the magnet drive assembly but is separated therefrom by a liquid-tight seal. The magnet drive assembly includes a plurality of circumferentially spaced apart driven permanent magnets. Bars cage the driven permanent magnets to prevent movement of the driven permanent magnets with respect to the hub.

More particularly as shown in FIGS. 1 through 6 of the drawings, the mixer 11 is shown mounted in the bottom wall 12 of a vessel or tank 13 and which is adapted to receive an aseptic liquid 14 to be stirred or mixed in the tank 13.

Figure 2:
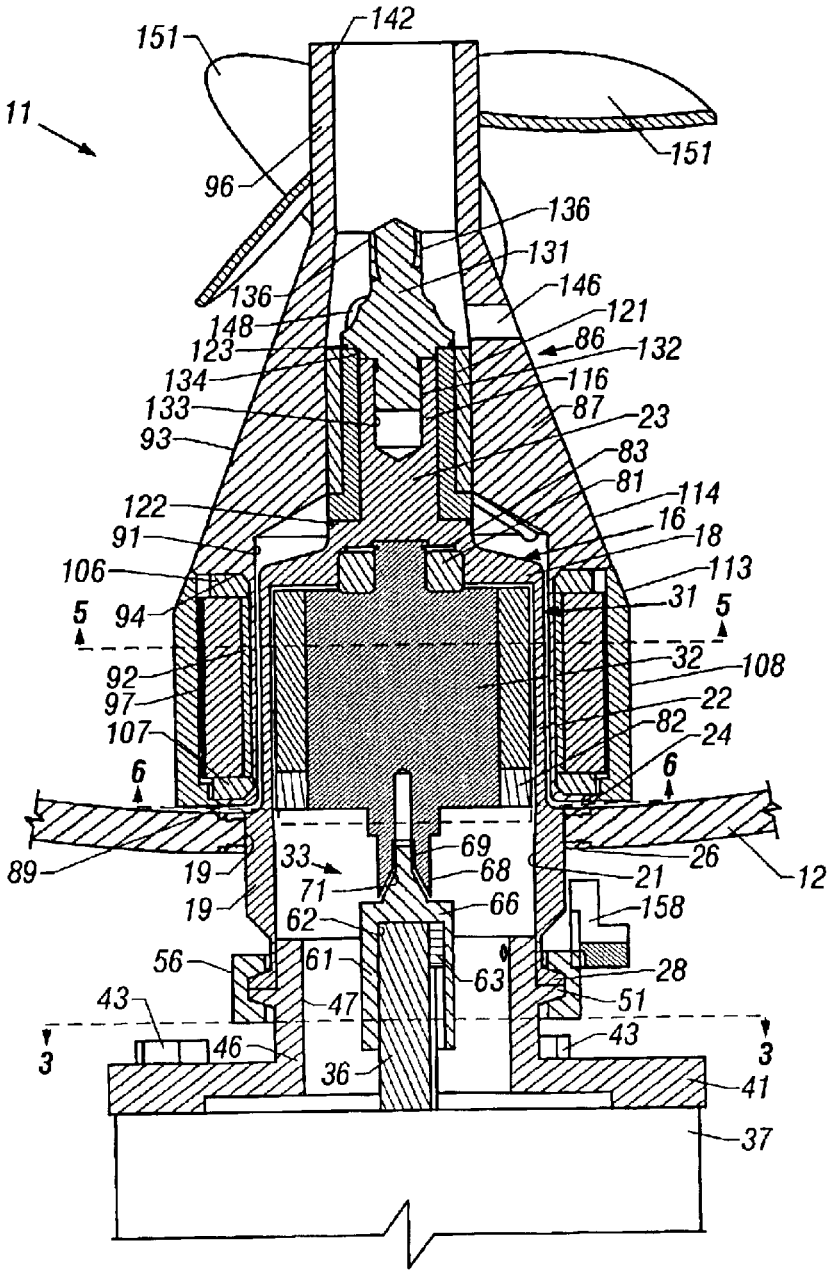
FIG. 2 is a cross sectional view of the mixer shown in FIG. 1.
Figure 3:
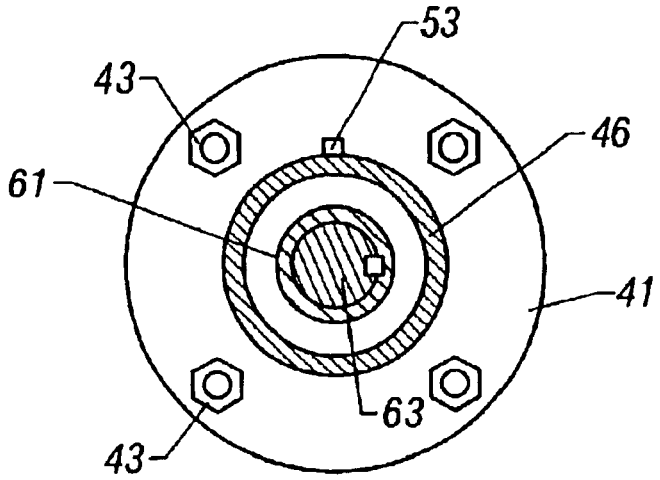
FIG. 3 is a cross sectional view taken along the line 3—3 of FIG. 2.
Figure 4:
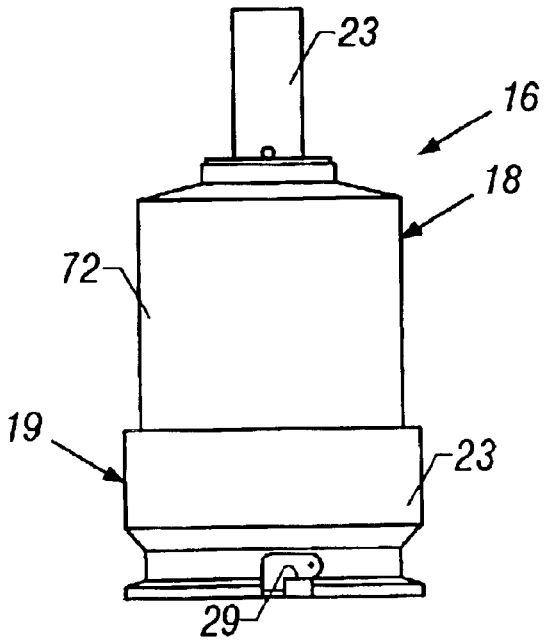
FIG. 4 is a cross sectional view taken along the line 4—4 of FIG. 2.

The mixer 11 consists of a weldment post 16 which is welded into the bottom wall 12 of the tank 13. As shown in FIGS. 2 and 4, the weldment post 16 is substantially cylindrical in shape and is formed of suitable non-ferrous metal as for example a low carbon stainless steel such as 316L so that it is transparent to magnetic flux. The weldment post 16 is provided with a distal cylindrical extremity 18 disposed within the vessel or tank 13 and extends upwardly from the bottom wall 12. It is also provided with a proximal extremity 19 which extends downwardly from the bottom wall 12 of the vessel or tank 13.

The weldment post 16 is provided with an axially extending bore 21 extending from the distal extremity and opening through the proximal extremity 19 so that the distal extremity 18 is provided with a thin side wall 22. This thin side wall 22 should be as thin as possible while providing the necessary rigidity and strength to maximize magnetic flux transfer as hereinafter described. In accordance with the present invention, this wall thickness is preferably approximately 0.085"±5%.

The uppermost portion 23 of the proximal extremity 19 is of thickness extending radially outwardly from the bore 21. It can have a thickness ranging from ¼" to ½" and preferably is approximately in thickness. It has a suitable length as for example 1"to make it possible to accommodate different wall thicknesses for the bottom wall 12 of the vessel or tank 13. That makes it possible to provide thick rigid welds as for example thick rigid upper and lower fillet welds 24 and 26 (see FIG. 2) which can be utilized to inhibit or prevent warpage of the bottom tank wall 12. The lowermost portion 27 is of reduced thickness and has provided thereon at its lowermost extremity a radially extending clamping flange 28. An L-shaped slot 29 extends upwardly through the flange 28 and then extends circumferentially in the lowermost portion 27. The slot 29 is provided for a purpose hereinafter described.

A magnet drive assembly 31 is rotatably mounted in the bore 21. The magnet drive assembly 31 consists of a drive shaft 32 which through cooperative coupling means 33 is coupled to a drive shaft 36 of an electric motor 37. The electric motor 37 can be of a suitable size as for example ½ HP up to 30 HP and can be AC or DC. Also alternatively it can be an air motor driven by compressed air.

The motor 37 is supported by the weldment post 16 by use of an adapter plate 41 which is adapted to fit NEMA frame motors as for example a 36C NEMA frame. The adapter plate 41 is provided with a plurality of bolt holes 42 as for example four equally spaced apart circumferentially of the adapter plate 41. The adapter plate 41 is in the form of a circular flat plate that overlies the motor 37 and is secured thereto by bolts 43 extending through the holes 42 and threaded into the motor 37. The adapter plate 41 is provided with a centrally disposed upstanding collar 46 which has a bore 47 extending therethrough. The collar 46 is provided with a radially extending clamping flange 51 on the outer surface thereof intermediate the upper and lower extremities of the collar 46 and is sized so that it can mate with the clamping flange 22 carried by the proximal extremity 19 of the weldment post 16. A radially extending cylindrical pin 53 is mounted on the collar 46 above the flange 51 and is sized so that it can be moved up into the L-shaped slot 29 provided on the weldment post 16 and then rotated to provide a temporary support for the motor 37. A sanitary clamp 56 of a conventional type is mounted over the mating flanges 28 and 51 to secure the flange 51 to the flange 22 and to thereby provide support for the adapter plate 41 and the motor 37 carried thereby.

A cylindrical shaft adapter 61 which is provided with a bore 62 for receiving the shaft 36 of the motor 37 is secured to the shaft 36 by a key 63 so that it will rotate therewith. A shaft adapter top 66 is secured to the shaft adapter 61 by suitable means such as welding. The shaft adapter top 66 is provided with a centrally disposed male-type bayonet type fitting 67 forming the male portion of the cooperative coupling means 33 which is formed by spaced apart tapered side walls 68 adjoining spaced-apart vertically extending walls 69. The magnet drive shaft 32 is formed of a suitable material such as 1018 stainless steel. The drive shaft 32 is provided with a female-type bayonet-type recess 71 which serves as the female portion of the cooperative coupling means 33.

Figure 5:
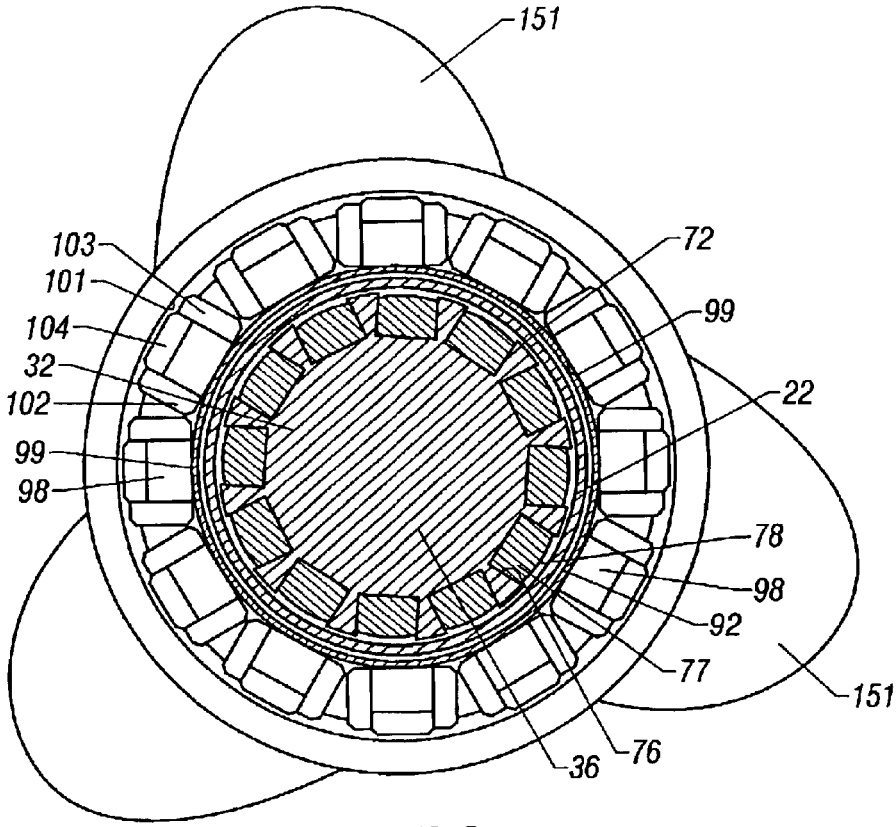
FIG. 5 is a side elevational view of the weldment post used in the mixer shown in FIGS. 1 and 2.
Figure 6:
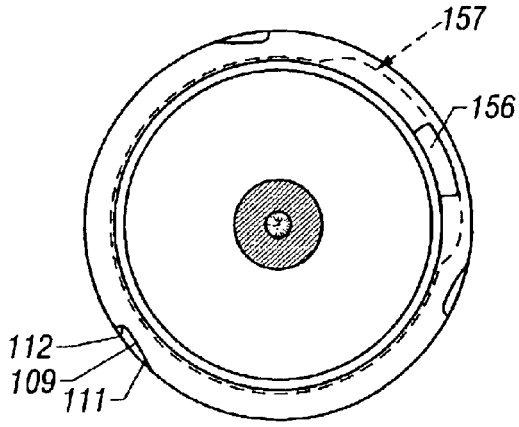
FIG. 6 is a cross sectional view taken along the line 5—5 of FIG. 2.

The drive shaft 32 is generally cylindrical in configuration and has an outer cylindrical surface 72 that is provided with a plurality as for example 12 axially extending recesses 76 as shown in FIG. 5 which are generally rectangular in cross section and which open through the outer cylindrical surface 72. A permanent drive magnet 77 is mounted in each of the recesses 76 and extends the length of the recess. The drive magnets 77 are typically of the rare earth type that generate a strong magnetic flux. For example one suitable rare earth material is samarium cobalt. It has very good magnetic qualities; however, it is relatively brittle and is also relatively expensive. The drive magnets 77 are generally rectangular in shape and in cross section fit closely within the rectangular recesses 76. They are held in place in a suitable manner such as by epoxy (not shown) so that the outer curved surfaces 78 of the magnets 77 are generally flush with the outer cylindrical surface 72 of the magnet drive shaft 71. The magnets 77 have longitudinal axes which are parallel to the axis of the shaft 32. The permanent drive magnets 77 have north and south poles which are perpendicular to the longitudinal axes. The outer surfaces 78 of the drive magnets 77 have north and south poles alternately spaced apart circumferentially around the cylindrical surface 72 of the drive shaft 36. The clearance between the outer surfaces or faces 78 of the drive magnets 77 and the inside surface of the wall 22 of the weldment post 16 may be from 0.150" to 0.20" and preferably about 0.185". It should be appreciated that it is desirable to have the faces of the magnets 77 travel in as close proximity as possible to the inner surface of the very thin stainless steel wall 22 of the weldment post 16 so there is a maximum transfer of magnetic flux from the drive magnets 77 through the wall 22 of the distal extremity 18 of the weldment post 16.

Means is provided for supporting the drive shaft 36 so it is rigidly and precisely maintained in its rotational position within the weldment post 16. Upper and lower double sided ball bearings 81 and 82 of a conventional type serve to mount the drive shaft 32 within the weldment post 16 and also serve to center the magnet drive shaft 32 and to hold it rigidly in position. The lower ball bearing 82 is secured in the bore 21 in a suitable manner such as by use of an epoxy. The upper ball bearing 81 is held in place by a snap ring 83 engaging the shaft 32. As can be seen, the drive magnets 77 are retained in their axial positions by the ball bearings 81 and 82 as well as being epoxied into place as hereinbefore described.

In case of disassembly, the magnet drive assembly 31 can be removed by threading a bolt (not shown) into a threaded opening (not shown) provided in the upper extremity of the drive shaft 32.

An impeller drive assembly 86 is mounted over the uppermost portion 23 of the distal extremity 18 of the weldment post 16. The impeller drive assembly 86 consists of hub 87 also formed of a non-ferrous material such as stainless steel 1013. The hub 87 is provided with a lower cylindrical extremity 88 that has a radially outwardly extending flange 89. A bore 91 extends through the hub 87 and is of varying diameters. In the lower cylindrical extremity 88, the bore 91 has a size so that a thin wall 92 is provided having a thickness which generally corresponds to the thickness of the wall 22 of the weldment post 16. The hub 87 is also provided with an intermediate flared portion 93 which forms a shoulder 94 which is generally parallel but spaced apart from the radially extending flange 89 with the thin wall 92 extending therebetween. The hub 87 is also provided with a cylindrical upper extremity 96. The lower cylindrical extremity 88 in conjunction with the flange 89 and the shoulder 94 forms a part of a magnet cage assembly 97. The magnet cage assembly 97 includes a plurality of circumferentially spaced apart elongate driven magnets 98 which also are rectangular in shape and cross section and have longitudinal axes which are parallel to the axis of the shaft 32. The magnets 98 have inner curved surfaces or faces 99 which are disposed in very close proximity to the inner surface of the cylindrical wall.

These driven magnets 98 are provided with north and south poles which face in directions perpendicular to the longitudinal or vertical axes of the driven magnets 98. Alternate circumferentially spaced apart faces of the driven magnets 98 are alternatively north and south poles. These driven magnets 98 are of the permanent type and can be formed of the same material as the drive magnets 77.

These driven permanent magnets 98 are caged within a cage 101 formed of mild steel bars generally rectangular in cross section surrounding the driven magnets in conjunction with the wall 92 (see FIG. 5). Three bars are provided for each magnet with two side bars 102 and 103 being disposed on opposite sides of the driven magnet 98 and the third or outer bar 104 being disposed on the outer surface of the driven magnet 98 opposite the face or inner surface 99 to encompass three of the four sides of each driven permanent magnet 98. These bars 102, 103 and 104 are tack welded to each other and to the wall 9892 of the lower cylindrical extremity 88 of the hub 87 to thereby encase the driven magnets 98 to prevent movement of the driven permanent magnets 98 with respect to the hub 87. The upper and lower extremities of the driven magnets 94.98 arc also caged by two upper and two lower semicircular magnet rings 106 and 107 which are also tack welded to the bars 102, 103 and 104 at opposite ends thereof. The lower magnet rings 107 are seated upon the outwardly extending radial flange 89 and are also tack welded to it. The upper magnet rings 106 are also tack welded to the shoulder 94.

A hub sleeve 108 is seated over the cage 101 and is welded to the hub 87 to provide a fluid-tight enclosure for the magnet cage assembly 97 so that the space containing the magnet cage assembly 97 cannot be entered by any liquid within the vessel or tank 13.

In order to provide a pumping action for lower levels of liquid within the tank 13, the hub sleeve 108 is provided with a plurality of circumferentially spaced apart notches 109 (see FIG. 7) as for example three which are spaced apart 120 degrees opening through the lower extremity of the hub sleeve 108 and facing outwardly from the hub sleeve 108. Each of the notches 109 is formed with a surface which 111 is inclined inwardly at a relatively small angle as for example 30° which adjoins another surface 112 which extends outwardly to provide a notch 109 which is generally L-shaped in configuration. Each of the notches 109 can have a suitable length as for example ½" and have a height of approximately ¼". The hub sleeve 108 is provided with an upper inclined surface 113 which mates with and adjoins an outer surface 114 of the intermediate flared portion 93 of the hub 87 to form a continuous sloping surface between the surfaces 113 and 114.

As shown particularly in FIG. 2 the magnet cage assembly 97 carried by the thin walled lower cylindrical extremity of the hub 87 fits over in relatively close proximity to the thin walled distal extremity 18 of the weldment post 16. With thin walls 22 and 98 being immediately adjacent to each other, the magnetic flux interaction between the drive magnets 77 and the driven magnets 98 is maximized.

Means is provided for rotatably supporting the hub 87 on the weldment post 16 and consists of a male bearing 116 which is generally L-shaped in cross section and a cylindrical female bearing 121, a large lower o-ring 122 and a small o-ring 123. The large o-ring 122 is first placed on the uppermost portion 23 of the distal extremity 18 of the weldment post 16 followed by the male bearing 116 which is secured to the weldment post 16 by a suitable means such as welding so that it remains stationary with the weldment post 16. Thereafter, the female bearing 121 is mounted on the male bearing 116 to mate therewith for rotation thereon. The small o-ring 123 is seated over the female bearing 121. The male bearing 116 and the female bearing 121 are formed of a suitable material such as a tungsten carbide with a 12% nickel binder. Alternatively and also for use in the biopharmaceutical industry a silicon carbide can be used. The o-rings 122 and 123 are conventional TEF-steel o-rings which are very desirable in the present use because they are long wearing and do not deform and provide a good liquid-tight seal.

A bearing shaft 131 is mounted on top of the uppermost portion 23 of the distal extremity 18 of the weldment post 16. The bearing shaft 131 is provided with threads 132 threaded into a threaded bore 133 in the uppermost portion 23. The bearing shaft 131 has a cylindrical portion 134 that fits into the male bearing 116 and permitting rotation of the female bearing 121 thereon. The bearing shaft 131 is provided with a pair of flats 136 to facilitate insertion and removal of the bearing shaft 131 with a tool (not shown).

A plurality of inclined holes 146 are provided in the hub and extend into the bore 142 provided in the hub 87. These hales serve to create low pressure areas on the outside of each hole in the hub so that during rotation of the hub these low pressure areas act as a pump to accelerate the flow of liquids up through the center of the impeller through the bore 142. This flow of liquid through these holes has two functions. The liquid serves to lubricate the bearings 114 and 116 and also takes away any heat which is created by friction in movement of the bearings 114 and 116 to thereby distribute the friction-created heat throughout the liquid in the vessel or tank 13. The inclined holes 146 are inclined at a suitable angle ranging from 5 to 15 degrees. As shown in FIG. 1, the holes are provided adjacent the very top edge of the female bearing 121. The bearing shaft 131 is provided with inclined surfaces 148 to provide smooth surfaces for receiving the inflow of liquid from the holes 146 and passing upwardly through the bore 142.

A plurality of impellers 151 as for example three as shown in the drawings are mounted on the hub 87. As desired by the customer, a wide range of different types of impellers or blades can be provided to achieve the desired mixing in the vessel or tank 13.

In order to measure the speed of rotation of the hub carrying the impellers 151, a strong permanent magnet 156 serving as a sensor element is mounted in the proximal extremity or base 94 of the hub 95. Sensing means 157 is mounted below the bottom wall 12 on the sanitary clamp 56 for sensing each rotation of the sensor element 156 and therefore directly measures the speed of rotation of the impellers 151 inside the tank 13 and not the speed of the drive motor 37.

A conventional controller 161 is provided as a part of the mixer 11 for operating the motor 37. It is provided with an on-off toggle switch 162 and a speed control knob 163 as well as other features.

Operation and use of the mixer 11 of the present invention may now be briefly described as follows. The mixer 11 can be installed by cutting a small hole as for example a two diameter hole in the bottom wall 12 of the tank if one is not already present and then welding the weldment post 16 into place to provide a weldment post 16 which extends upwardly into the interior of the vessel or tank 13. The hub 87 carrying the impellers 151 and the impeller drive assembly 86 is lowered onto the weldment post 16.

As soon as this has been accomplished, the magnet drive assembly 31 can be inserted from outside of the vessel or tank 13 into the bore 21 of the weldment post 16. When the drive assembly 31 is approximately one half way toward the home position, the magnetic forces of the drive magnets 77 coacting with the magnetic forces from the driven magnets 91 cause the drive assembly 31 to snap into place and be automatically aligned circumferentially. As soon as this has been accomplished, the adapter plate 41 carrying the motor 37 can be moved into place to cause the pin 53 to be seated in the bayonet type recess 71 of the weldment post 16. Thereafter, the sanitary clamp 56 can be affixed to secure the adapter plate 41 and the motor 37 carried thereby in a fixed position.

As soon as the assembly of the mixer 11 has been completed, the vessel or tank 13 is ready to be used in a process. When the vessel has been filled to the desired level with a liquid to be mixed in the tank 13, the mixer can be placed in operation to cause agitation and mixing of the liquid in the tank in a conventional manner. During the mixing of the liquid, liquid will pass through the holes 146 which are inclined in a backward direction with respect to the direction of rotation of the impeller blades 151 to cause liquid to enter through the holes 146 and to cool the male and female bearings 116 and 121 and also collect any heat which may be generated by the bearings and distributing this heat throughout the liquid in the tank or vessel. By this continuous mixing, the cells in the liquid are kept in motion. No cells are trapped within the mixer where they could die. By this continuous mixing in this manner it is possible to keep the cells alive by maintaining them in contact with oxygen bubbles in the liquid.

The holes 146 also serve an additional function during cleaning of the tank. For example cleaning may be accomplished with the mixer assembly in place by flooding it with a cleaning liquid to actually immerse the impeller blades 151 while they are rotating in the cleaning liquid followed by cleansing the same in water. Alternatively the tank can be drained of liquid and then a cleaning fluid introduced by the use of a spray ball (not shown) mounted near the top of the tank to shower the mixer assembly with the cleaning fluid. The holes 146 facilitate movement of the cleaning liquid through to clean the mixer assembly. As the liquid in the tank is being drained from the tank it falls below the level of the impeller blades 151, mixing of the liquid in the tank below this level normally would be radically eliminated but for the fact that in the present invention, notches 117 have been provided at the bottom most surface of the hub 87 to cause agitation and mixing of the liquid in the lowermost levels of the tank. Thus, substantially continuous mixing of the liquid in the tank occurs even when the liquid is being drained from the tank. By the use of the strong magnet on the bottom of the hub, it is possible to measure true impeller rpm rather than the speed of the motor driving the impeller hub.

Thus it can be seen that the mixer 11 of the present invention has a number of important features. As pointed out above, true impeller rpm is measured to make possible timed mixing cycles. The construction of the mixer 11 is very robust and can be readily installed without warpage of the tank wall. Also it has a relatively small footprint. A variety of agitation blades can be provided on the impeller hub. By installation of the weldment posts of the type hereinbefore described in a plurality of tanks, it is possible to move the motor drives and impeller hubs from tank to tank as needed. The construction of the hub makes it possible to agitate and mix the liquids in the tank during drainage of the tank until the tank is completely drained. The use of the weldment post of the present invention provides a rigid cylindrical portion of substantial height for welding into a small diameter hole in the tank bottom without deformation of the tank bottom.

Since the sensing element is mounted in the impeller hub 87 it is possible to measure the rotation of the hub 87 from outside the tank. The use of the weldment post of the present invention makes it possible to work with a small hole in the bottom wall of the tank. By providing thick rigid welds between the weldment post and the tank, warpage is reduced to a minimum. By utilizing close tolerances and thin walls separating the drive assembly from the driven assembly, it is possible to provide a much closer magnetic coupling between the two assemblies and thereby deliver a higher torque. By providing a drive unit which is centered between the upper and lower ball bearings it is possible to maintain a rigid position for mounting of the magnet drive assembly. By mounting the driven magnets in cages it is possible to keep the magnets locked in welded cages so they cannot move, preventing wobbling and degeneration of the magnetic coupling between the drive assembly and the driven assembly. The large backwardly facing holes in the rotating impeller hub inside the tank create low pressure areas which during rotation act as a pump during normal operation of the mixer and also to pull cleaning fluid through the inside of the hub during cleaning operations. The large diameter bore in the impeller hub permits liquids to flow therein without substantial interference. The parts used in the mixer have been designed with radiused edges to reduce the retention of a meniscus on the bearings and thereby supports the flow of aseptic liquids and cleaning fluid. The large bore in the impeller hub can accommodate the use of an extension shaft (not shown) for delivering the desired agitation to all areas of the tank, thereby combining the abilities of top mounted and bottom mounted mixers.

What is claimed:

1. A mixer for an aseptic liquid in a vessel having a wall and having an opening therein and containing the aseptic liquid to be mixed comprising a weldment post extending through the opening in the wall and being adapted to be welded into the wall to form a liquid-tight seal with the wall of the vessel, the weldment post having a distal extremity inside the wall and having a proximal extremity outside the wall, the weldment post having a bore therein extending out through the proximal extremity of the weldment post, a magnet drive assembly disposed in the bore in the weldment post and a drive motor carried by the weldment post for driving the magnet drive assembly, a hub rotatably mounted on the weldment post, impellers mounted on the hub, a magnet driven assembly mounted in the hub and being disposed in close proximity to the magnet drive assembly but being separated therefrom by a liquid-tight seal, said magnet drive assembly having a plurality of circumferentially spaced apart driven permanent magnets and further including means for caging said driven permanent magnets to prevent movement of the driven permanent magnets relative to the hub.

2. A mixer as in claim 1 wherein said magnet drive assembly includes a plurality of circumferentially spaced apart drive permanent magnets, said magnet drive assembly and said magnet driven assembly being separated from each other by first and second walls formed of a non-ferrous material and permitting close coupling of the magnetic flux generated by the drive permanent magnets and the driven permanent magnets.

3. A mixer as in claim 2 wherein said weldment post is provided with a thin wall in the vicinity of the drive permanent magnets and wherein the hub is provided with a thin wall in the vicinity of the driven permanent magnets.

4. A mixer as in claim 1 wherein said hub is rotatably mounted on the weldment post by first and second bearings disposed within the hub, said hub having at least one hole therein in close proximity to at least one of the bearings permitting liquid to flow therethrough to remove heat generated by the at least one of the bearings.

5. A mixer as in claim 4 wherein said hub is provided with a bore and wherein said hole in said hub is in communication with said bore whereby as the hub is rotated, liquid can flow into the hole and into the bore.

6. A mixer as in claim 5 wherein said hole is inclined in a backward direction in connection with the direction of rotation of the hub.

7. A mixer as in claim 1 wherein said weldment post is provided with a proximal portion of increased wall thickness to make possible a rigid connection between the wall of the tank and the weldment post and for inhibiting warpage of the wall of the vessel.

8. A mixer for an aseptic liquid in a vessel having a wall and having an opening therein and containing the aseptic liquid to be mixed comprising a weldment post extending through the opening in the wall and being adapted to be welded into the wall to form a liquid-tight seal with the wall of the vessel, the weldment nest having a distal extremity inside the wall and having a proximal extremity outside the wall, the weldment post having a bore therein extending out through the proximal extremity of the weldment post, a magnet drive assembly disposed in the bore in the weldment nost and a drive motor carried by the weldment post for driving the magnet drive assembly, a hub rotatably mounted on the weldment post, impellers mounted on the hub, a magnet driven assembly mounted in the hub and being disposed in close proximity to the magnet drive assembly but being separated therefrom by a liquid-tight seal, said magnet drive assembly having a plurality of circumferentially spaced apart driven permanent magnets and further including means for caging said driven permanent magnets to prevent movement of the driven permanent magnets relative to the hub, said hub being provided with a proximal extremity having notches formed therein opening downwardly and sidewardly from the hub for causing agitation of the aseptic liquid in the vessel as the hub is rotated.

9. A mixer as in claim 8 wherein said magnet drive assembly includes a plurality of circumferentially spaced apart drive permanent magnets, said magnet drive assembly and said magnet driven assembly being separated from each other by first and second walls formed of a non-ferrous material and permitting close coupling of the magnetic flux generated by the drive permanent magnets and the driven permanent magnets.

10. A mixer as in claim 9 wherein said weldment post is provided with a thin wall in the vicinity of the drive permanent magnets and wherein the hub is provided with a thin wall in the vicinity of the driven permanent magnets.

11. A mixer as in claim 8 wherein said hub is rotatably mounted on the weldment post by first and second bearings disposed within the hub, said hub having at least one hole therein in close proximity to at least one of the bearings permitting liquid to flow therethrough to remove heat generated by the at least one of the bearings.

12. A mixer as in claim 11 wherein said hub is provided with a bore and wherein said hole in said hub is in communication with said bore whereby as the hub is rotated, liquid can flow into the hole and into the bore.

13. A mixer as in claim 12 wherein said hole is inclined in a backward direction in connection with the direction of rotation of the hub.

14. A mixer as in claim 8 wherein said weldment post is provided with a proximal portion of increased wall thickness to make possible a rigid connection between the wall of the tank and the weldment post and for inhibiting warpage of the wall of the vessel.

15. A mixer for an aseptic liquid in a vessel having a wall and having an opening therein and containing the aseptic liquid to be mixed comprising a weldment post extending through the opening in the wall and being adapted to be welded into the wall to form a liquid-tight seal with the wall of the vessel, the weldment cost having a distal extremity inside the wall and having a proximal extremity outside the wall, the weldment Post having a bore therein extending out through the proximal extremity of the weldment post, a magnet drive assembly disposed in the bore in the weldment post and a drive motor carried by the weldment post for driving the magnet drive assembly, a hub rotatably mounted on the weldment post, impellers mounted on the hub, a magnet driven assembly mounted in the hub and being disposed in close proximity to the magnet drive assembly but being separated therefrom by a liquid-tight seal, said magnet drive assembly having a plurality of circumferentially spaced apart driven permanent magnets and further including means car caging said driven permanent magnets to prevent movement of the driven permanent magnets relative to the hub, a sensor element carried by the proximal extremity of the hub and means external of the tank for sensing rotation of the sensor element carried by the hub.

16. A mixer as in claim 15 wherein said magnet drive assembly includes a plurality of circumferentially spaced apart drive permanent magnets, said magnet drive assembly and said magnet driven assembly being separated from each other by first and second walls formed of a non-ferrous material and permitting close coupling of the magnetic flux generated by the drive permanent magnets and the driven permanent magnets.

17. A mixer as in claim 16 wherein said weldment post is provided with a thin wall in the vicinity of the drive permanent magnets and wherein the hub is provided with a thin wall in the vicinity of the driven permanent magnets.

18. A mixer as in claim 15 wherein said hub is rotatably mounted on the weldment post by first and second bearings disposed within the hub, said hub having at least one hole therein in close proximity to at least one of the bearings permitting liquid to flow therethrough to remove heat generated by the at least one of the bearings.

19. A mixer as in claim 18 wherein said hub is provided with a bore and wherein said hole in said hub is in communication with said bore whereby as the hub is rotated, liquid can flow into the hole and into the bore.

20. A mixer in claim 19 wherein said hole is inclined in a backward direction in connection with the direction of rotation of the hub.

21. A mixer as in claim 15 wherein said weldment post is provided with a proximal portion of increased wall thickness to make possible a rigid connection between the wall of the tank and the weldment post and for inhibiting warpage of the wall of the vessel.

22. A mixer for an aseptic liquid in a vessel having a wall and having an opening therein and containing the aseptic liquid to be mixed comprising a weldment post extending through the opening in the wall and being adapted to be welded into the wall to form a liquid-tight seal with the wall of the vessel, the weldment post having a distal extremity inside the wall and having a proximal extremity outside the wall, the weldment post having a bore therein extending out through the proximal extremity of the weldment post, a magnet drive assembly disposed in the bore in the weldment post and a drive motor carried by the weldment nost for driving the magnet drive assembly, a hub rotatably mounted on the weldment post, impellers mounted on the hub, a magnet driven assembly mounted in the hub and being disposed in close proximity to the magnet drive assembly but being separated therefrom by a liquid-tight seal, said magnet drive assembly having a plurality of circumferentially spaced apart driven permanent magnets and further including means for caging said driven permanent magnets to prevent movement of the driven Permanent magnets relative to the hub, said means for caging said driven permanent magnets including bars encompassing at least a portion of each of said driven magnets and bonded to the hub.

23. A mixer as in claim 22 wherein each of said driven permanent magnets is rectangular in cross section having four sides with one of the four sides facing the drive permanent magnets and wherein the bars are disposed on the other three sides.

24. A mixer as in claim 23 wherein said bars are formed of a mild steel.

25. A mixer as in claim 22 wherein said magnet drive assembly includes a plurality of circumferentially spaced apart drive permanent magnets, said magnet drive assembly and said magnet driven assembly being separated from each other by first and second walls formed of a non-ferrous material and permitting close coupling of the magnetic flux generated by the drive permanent magnets and the driven permanent magnets.

26. A mixer as in claim 25 wherein said weldment post is provided with a thin wall in the vicinity of the drive permanent magnets and wherein the hub is provided with a thin wall in the vicinity of the driven permanent magnets.

27. A mixer as in claim 22 wherein said hub is rotatably mounted on the weldment post by first and second bearings disposed within the hub, said hub having at least one hole therein in close proximity to at least one of the bearings permitting liquid to flow therethrough to remove heat generated by the at least one of the bearings.

28. A mixer as in claim 27 wherein said hub is provided with a bore and wherein said hole in said hub is in communication with said bore whereby as the hub is rotated, liquid can flow into the hole and into the bore.

29. A mixer as in claim 28 wherein said hole is inclined in a backward direction in connection with the direction of rotation of the hub.

30. A mixer as in claim 22 wherein said weldment post is provided with a proximal portion of increased wall thickness to make possible a rigid connection between the wall of the tank and the weldment post and for inhibiting warpage of the wall of the vessel.

* * * * *